United States Patent [19]

Chien

[11] 4,213,740

[45] Jul. 22, 1980

[54] OILFIELD PUMP STROKE MONITOR

[75] Inventor: Loring C. Chien, Houston, Tex.

[73] Assignee: Dresser Industries, Inc., Dallas, Tex.

[21] Appl. No.: 924,526

[22] Filed: Jul. 14, 1978

[51] Int. Cl.[2] ..... F04B 21/00

[52] U.S. Cl. ..... 417/63

[58] Field of Search ..... 417/63, 24, 42; 73/493, 73/494, 151, 168, 517 A, 508

[56] References Cited

U.S. PATENT DOCUMENTS

| | | | |
|---|---|---|---|
| 2,436,235 | 2/1948 | Sunstein | 234/1.5 |
| 2,821,698 | 1/1958 | Richardson | 417/63 X |
| 3,046,792 | 7/1962 | Morgan | 73/490 |
| 3,315,224 | 4/1967 | Ferguson | 73/151 X |
| 3,614,761 | 10/1971 | Rehm et al. | 417/63 X |
| 3,716,707 | 2/1973 | Sharki et al. | 137/624.18 |
| 3,717,857 | 2/1973 | Evans | 340/177 R |
| 3,789,935 | 2/1974 | Saadeh | 73/516 LM |
| 3,945,646 | 3/1976 | Hammond | 73/493 X |
| 3,962,911 | 6/1976 | Grenlund | 73/769 X |
| 3,972,038 | 7/1976 | Fletcher et al. | 73/493 X |
| 4,041,780 | 8/1977 | Angehrn | 73/151 |
| 4,076,458 | 2/1978 | Jones | 417/63 X |

*Primary Examiner*—Carlton R. Croyle
*Assistant Examiner*—Edward Look
*Attorney, Agent, or Firm*—Daniel Rubin; Eddie E. Scott

[57] ABSTRACT

The pumping rate of an oil well pump or other recurring event is determined by providing a force sensor, such as an accelerometer, and a transmitter arranged in a housing adapted to be affixed to the pump piston rod or drive train which move in a vertical plane. As the piston rod or drive train moves, the sensor measures gravitational and centrifugal forces, the former providing a sinousoidally varying sensor output having a period equal to the rotational or reciprocal period of the piston rod or drive train. The transmitter is a battery-powered R.F. device which is activated once each stroke or revolution by an amplifier-detector coupled to the output of the force sensor. A one-shot multivibrator is used to transmit a short burst during the on-time and such burst may be modulated for better noise rejection by the receiver. The receiver is located remote from the sensor/transmitter package and comprises an R.F. detector, amplifier and, if required, a demodulator. Each output pulse from the receiver circuit represents one rotation or oscillation of the machine element.

3 Claims, 4 Drawing Figures

OILFIELD PUMP STROKE MONITOR

TECHNICAL FIELD

The present invention relates in general to oilfield equipment and in particular to the measurement of a recurring event. A preferred embodiment of the invention relates to equipment for the oil and gas drilling and production industry and particularly to an event sensor for rotary or reciprocal oilfield machinery.

BACKGROUND OF THE INVENTION

In the art of drilling oil and gas wells, it is well known to count certain reoccuring events, such as the revolutions of the drill pipe, the number of strokes of a mud pump or the like. For example, during oil and gas drilling and production operations it is necessary to monitor various events to provide adequate control and safety. The pump stroke of the drilling mud slush pump is continuously monitored during an oil and gas well drilling operation to monitor the mud being pumped into the well. In the prior art, mechanical contact switching systems have been used to count the pump strokes. These mechanical connections have disadvantages and in order to advance the state of the art of oil and gas drilling and production, it is desirable to improve the systems for transmitting pump stroke information. The prior art systems have encountered the problems of poor access to the reciprocating or rotary element due to its motion and location, and vulnerability of pick-ups due to routine machine maintenance and wear of contacting parts. The present invention will result in fewer service problems due to failure or misalignment and will provide consistent accuracy.

DESCRIPTION OF PRIOR ART

Prior art systems have used limit switches activated by the rotating element or the reciprocating rod. Usually access to this element or rod was at a service entrance where routine mechanical maintenance resulted in physical displacement of the sensor. The present invention can be attached to the machinery element in a position that is more accessible but less likely to be tampered with. An understanding of the uses of such a system in oil well drilling and production operations can be obtained from a review of U.S. Pat. No. 3,614,716; U.S. Pat. No. 3,608,653 and U.S. Pat. No. 3,740,739. These systems disclose various monitoring systems for monitoring potential blowouts and lost circulation in an oil well drilling operation.

In U.S. Pat. No. 3,716,707 to M. J. Sharki et al, patented Feb. 13, 1973 and U.S. Pat. No. 3,929,014 to M. J. Sharki, patented Dec. 30, 1975, pneumatic ratemeters and counters are shown. A sensor valve receives a mechanical force from a pump rod and operates to pressurize an air tank from a regulated air supply.

SUMMARY OF THE INVENTION

Pump stroke counting or the determination of other recurring events is determined by providing a force sensor, such as an accelerometer, and a transmitter arranged in a housing adapted to be affixed to a pump piston rod or drive train of the equipment to be monitored. A receiver is positioned at a distance from the force sensor/transmitter and receives the signal from the transmitter. The absence of moving parts or contacts improves the reliability and performance of the present invention. The foregoing and other features and advantages of the present invention will become apparent from a consideration of the following detailed description of the invention when taken in conjunction with the accompanying drawings.

DETAILED DESCRIPTION OF THE INVENTION

Figure 1:
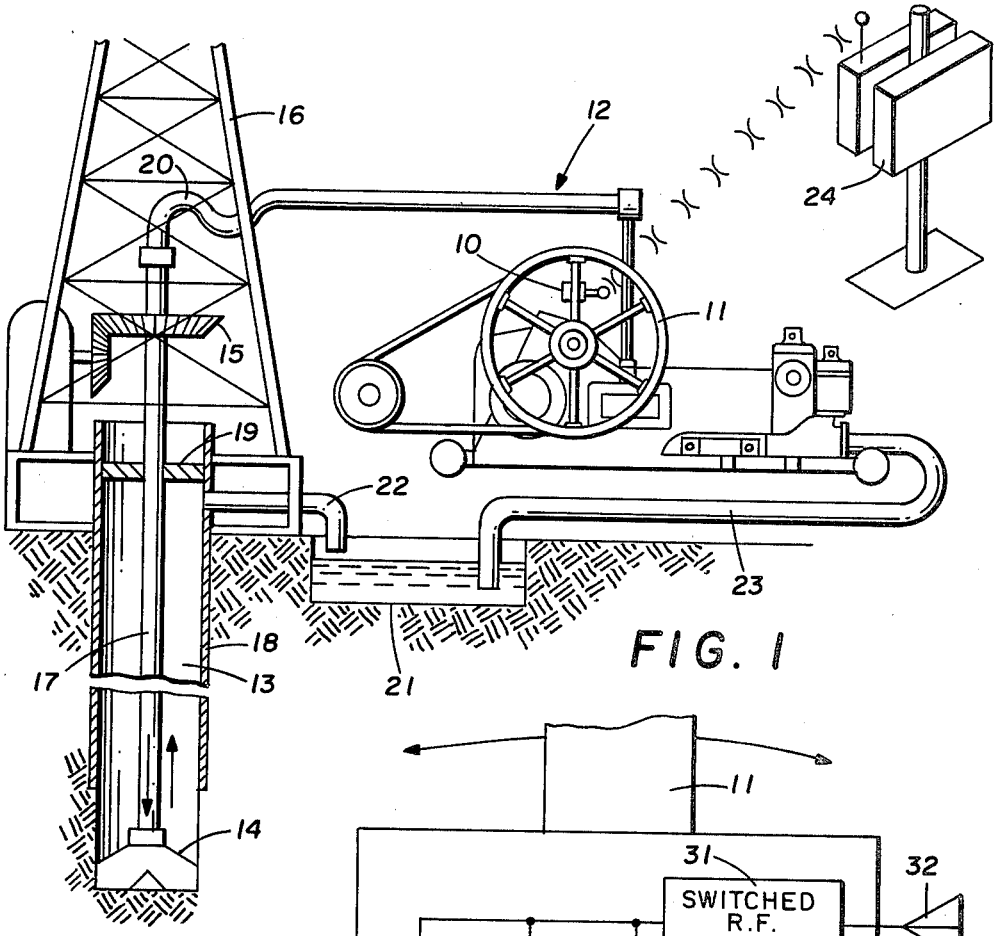
FIG. 1 is an illustration of one embodiment of the present invention incorporated in a slush pump used in an oil well drilling operation.

Referring now to the drawings, and in particular to FIG. 1, an embodiment of the present invention is illustrated in conjunction with a slush pump 12 used for pumping drilling mud during an oil well drilling operation. A well bore 13 is shown having the usual casing 18. The well bore 13 contains the rotary drill string 17. The rotary drill string 17 is provided with a bit 14 at its lower end. The drill string 17 is turned by a rotary table 15 mounted in the derrick 16. Drilling mud is pumped from a mud pit 21 through line 23 by pump 12 through a mud delivery line 20 into the drill string 17 and is discharged out of the bit 14 into the well bore 13 and returned from the top of the casing 18 by a mud flowline 22 to the mud pit 21. An openable and closable blowout preventer or rotary drill head 19 of any suitable conventional type is provided at the upper end of the casing 18.

It is necessary to monitor various parameters during the drilling of the well. For example, one of the parameters is the stroke rate of the mud pump that circulates the drilling mud. An example of the need for monitoring this parameter is the danger of blowout in a well. High pressure gas from the underground reservoir pierced by the borehole may enter the borehole and displace mud out of the borehole into the mud pits. The removal of the mud from the borehole decreases the pressure opposite the underground reservoir and allows more gas to enter the borehole. This is a cycle that can lead to a blowout of the well if action is not taken to correct it. By monitoring the volume of mud going into the borehole and the volume of mud returning to the mud pits, it is possible to obtain a warning of an impending blowout. It will therefore be seen that reliable and constant measurement of the pump stroke of the mud pumps is a necessary part of such a monitoring system because this allows an accurate determination of the volume of mud being pumped into the well.

The present invention comprises a force sensor, transmitter, receiver and signal conditioning components. The force sensor and transmitter are in one package. As shown in FIG. 1, the force sensor and transmitter package 10 is mounted in a fixed position on the rotating element 11 of the equipment to be measured. The force sensor and transmitter package 10 is mounted on the bull wheel 11 of the oilfield slush pump 12. This element rotates in a vertical plane. The force sensor measures the force between a weight and the bull wheel in one degree of freedom lying in the plane of the wheel 11. The force sensor and transmitter package 11 comprises a force sensor, such as an accelerometer, and a transmitter arranged in a housing adapted to be affixed to the machine element 11 which rotates in a vertical plane. As the element 11 rotates, the sensor measures gravitational and centrifugal forces, the former providing a sinousoidally varying sensor output having a period equal to the rotational period of the machine element 11. The transmitter is a battery-powered R.F. device which is activated once each revolution by an amplifier-detector A.C.-coupled to the output of the force sensor. A one-shot multivibrator is used to transmit a short burst during the on-time and such burst may be modulated for better noise rejection by the receiver. The receiver 24 is located remotely from the sensor/transmitter package 10 and comprises an R.F., detector, amplifier and, if required, a demodulator. Each output pulse from the receiver circuit represents one rotation of the machine element and division circuits are employed if it is desired to determine events of machine components other than the rotating element and having gear ratios with respect to the rotating element which differ from 1:1. The outputs are typically used for totalization of events and event rate determinations.

Figure 2:
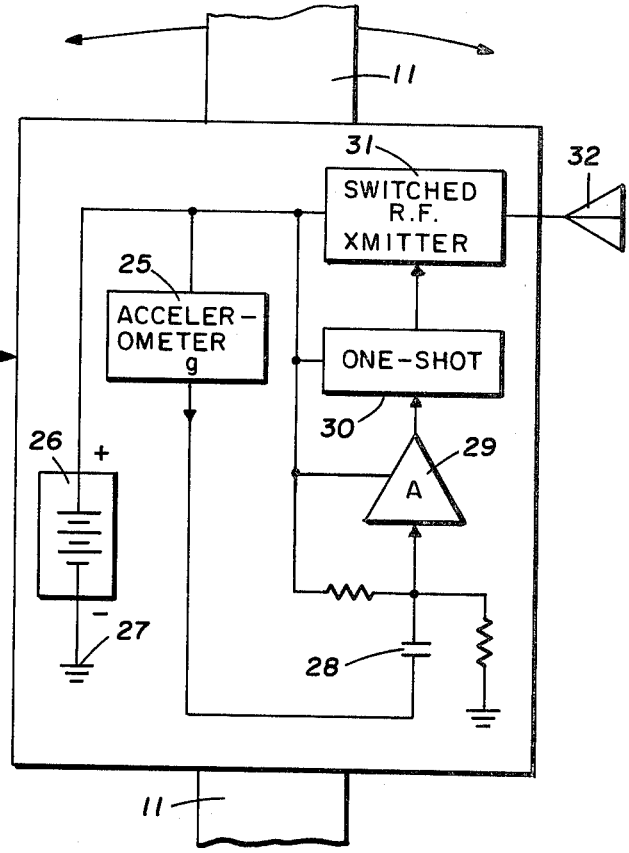
FIG. 2 is an illustration block diagram of a portion of the system shown in FIG. 1.

The alignment of the sensor/transmitter package 10 in relation to the bull wheel 11 is shown in FIG. 2. As the wheel 11 rotates at a constant angular velocity, the sensor/transmitter 10 will measure two components of force, one due to gravitational forces and one due to centrifugal forces of the wheel 11. The former is sinousoidally varying with a period equal to the rotation period and the latter is a constant force due to the rotation of the wheel. The transmitter is a low power R.F. device 31, switched on once each rotation by an amplifier-detector 29 which is A.C.-coupled to the output of the accelerometer 25. The on period may be brief provided by one-shot control 30, and the transmitted burst may be modulated for better noise rejection by the receiver. Since the transmitter is switched on for a short period compared to the rotating period, it may be operated by batteries 26 or some internal generator, giving it long, useful life and little maintenance.

Figure 3:
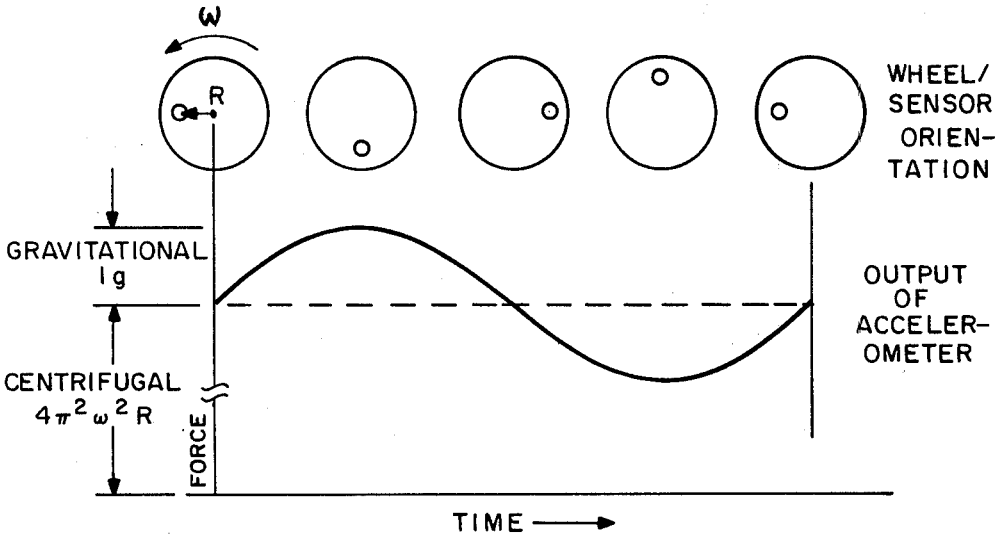
FIG. 3 is an illustrative graph providing additional information about the subject invention.

FIG. 3 is a graph illustrating the output of the force sensor for various positions of the wheel/sensor combination when rotating at a constant angular velocity "$\omega$". The output for a complete cycle of the wheel 11 due to the gravitational vector is represented by the sinousoidal portion of the waveform. The centrifugal force is represented by the constant part of the output, and is proportional to $4\pi\omega^2R^2$.

Figure 4:
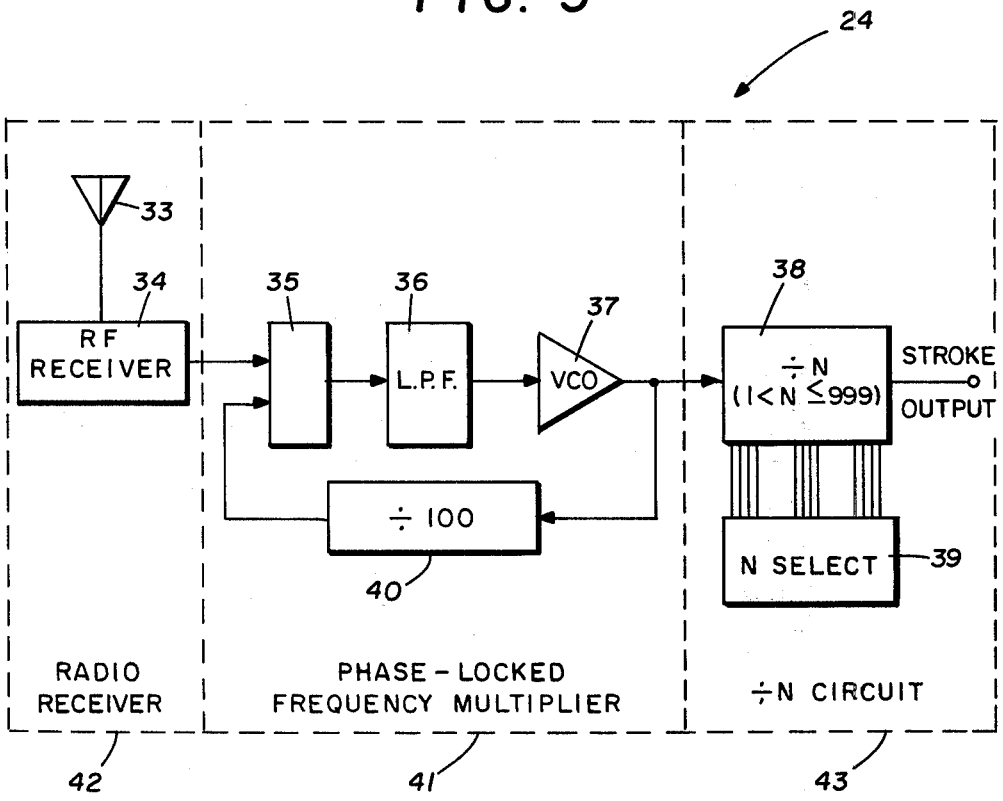
FIG. 4 shows a block diagram illustrating a portion of the system shown in FIG. 1.

Referring now to FIG. 4, the receiver 24 is illustrated by a block diagram. The receiver 24 consists of three parts, a radio receiver 42, a phase-locked frequency multiplier 41 and a divide by N circuit 43. The radio receiver portion 42 consists in turn of an antenna 33 and R.F. receiver 34 (detector, amplifier). If desired, a demodulator may be contained in R.F. receiver 34. The output of the radio receiver section is one pulse per revolution of the bull wheel. The phase-locked frequency multiplier 41 and divide by N circuit 43 sections provide correction to the desired sensed event.

In order to provide an output representative of the reciprocating action initially desired to be monitored it is necessary to divide the pulses by the gearing ratio between the bull wheel 11 and the pump piston rod. In the system shown in FIG. 1, the event being monitored is the pump stroke of the slush pump 12. The stroke of the pump piston rod will be related to the rotation of the bull wheel 11 by a fixed ratio dependent upon the gearing involved.

The phase-locked frequency multiplier 41 comprises a phase detector 35, low pass filter (L.P.F.) 36, voltage controlled oscillator (V.C.O.) 37 and feedback frequency divider (of one hundred) 40 as illustrated. The output of the multiplier 41 is 100 pulses per bull wheel revolution. Part three of the receiver 24 is a divide by N circuit 38 where N is an integer set into the circuit externally by the N select unit 39. The divide by N circuit, for example, may be a CD 4018 manufactured by RCA or other manufactures' 4018 circuits. The pulse output of the receiver 24 is the pulse output of the divide by N circuit 38 which corresponds directly to each linear reciprocating action. In the slush pump example of FIG. 1, this corresponds to pump stroke, when N is properly set. For oilfield type slush pumps, the gear ratio ranges from about 2.50 to 8.00 and the actual ratio determines N.

The embodiments of the invention in which an exclusive property or privilege is claimed are defined as follows:

1. An apparatus for determining the pump strokes of a pump having a moving element that moves cyclically, comprising:

a force sensor mounted on said moving element for sensing said cyclic movement and generating a signal;

an R.F. transmitter mounted on said moving element connected to receive said signal from said force sensor and transmit an R.F. signal; and an R.F. receiver spaced from said moving element for receiving said R.F. signal from said R.F. transmitter and indicating said pump strokes.

2. An apparatus for determining the pump strokes of a pump having an element that is in cyclic motion during the operation of the pump, comprising:

an accelerometer on said element that detects said cyclic motion and generates a signal indicating said cyclic motion;

an R.F. transmitter on said element connected to said accelerometer that receives said signal from said accelerometer and transmits an R.F. signal indicating said cyclic motion; and an R.F. receiver spaced from said transmitter for receiving said R.F. signal from said R.F. transmitter and indicating said pump strokes.

3. An apparatus for determining the pump strokes of a pump having a piston and a bull wheel that are in cyclic motion during the operation of the pump, comprising:

an accelerometer on said bull wheel that detects said cyclic motion and generates a signal indicating said cyclic motion;

an R.F. transmitter on said bull wheel connected to said accelerometer that receives said signal from said accelerometer and transmits an R.F. signal indicating said cyclic motion; and an R.F. receiver spaced from said transmitter for receiving said R.F. signal from said R.F. transmitter and providing an output that represents said cyclic motion and indicates said pump strokes.

* * * * *